United States Patent [19]

Baucom et al.

[11] Patent Number: 4,944,390

[45] Date of Patent: Jul. 31, 1990

[54] MERCHANDISING SYSTEM FOR PAINT BRUSHES AND THE LIKE

[75] Inventors: William E. Baucom; Jeff Augustine, both of Canton, Ohio

[73] Assignee: The Wooster Brush Company, Wooster, Ohio

[21] Appl. No.: 459,543

[22] Filed: Jan. 2, 1990

[51] Int. Cl.[5] ..... A47B 81/02; B65D 5/50; B65D 5/52; A47F 5/00

[52] U.S. Cl. ..... 206/44 R; 206/362; 206/362.4; 206/45.14; 211/65; 211/66; 211/88; 211/106; 211/181

[58] Field of Search ..... 206/44 R, 45.14, 362, 206/362.4; 211/65, 66, 88, 106, 181

[56] References Cited

U.S. PATENT DOCUMENTS

| | | | |
|---|---|---|---|
| 2,996,192 | 8/1961 | Dell et al. | 211/106 X |
| 3,245,547 | 4/1966 | Felkay | 211/66 X |
| 3,693,808 | 9/1972 | Rauch | 211/181 |
| 4,248,352 | 2/1981 | White | 211/88 |
| 4,511,047 | 4/1985 | Elinsky | 206/44 R |
| 4,723,663 | 2/1988 | Learn | 211/66 X |
| 4,742,923 | 5/1988 | Calvert | 211/66 X |
| 4,798,297 | 1/1989 | Weiss et al. | 211/65 |
| 4,813,535 | 3/1989 | Radocha et al. | 206/362 X |
| 4,860,891 | 8/1989 | Biggio | 206/362 |

FOREIGN PATENT DOCUMENTS

| | | | |
|---|---|---|---|
| 1128656 | 8/1956 | France | 211/181 |

*Primary Examiner*—William Price

*Attorney, Agent, or Firm*—Renner, Otto, Boisselle & Sklar

[57] ABSTRACT

A merchandising system for paint brushes and the like characterized by open-top shipping cartons each having a removable top cover and a wire frame within the carton having a base member retained against the bottom wall of the carton and a plurality of pegs extending generally perpendicular from the base member in spaced apart relation for supporting a plurality of brushes from each of the pegs. To display the brushes, the top cover is removed from the cartons and the cartons are inserted in a bracket which supports the cartons at an angle relative to an upstanding panel member with the brushes hanging downwardly at such angle from such pegs.

25 Claims, 5 Drawing Sheets

MERCHANDISING SYSTEM FOR PAINT BRUSHES AND THE LIKE

TECHNICAL FIELD OF THE INVENTION

This invention relates generally, as indicated, to a merchandising system for paint brushes and the like. An important aspect of the system is that the same cartons that are used to ship the brushes to the retailer are also used to display the brushes on a merchandiser much in the same manner as a hook merchandiser but without the need for having to insert the individual brushes by hand onto the merchandiser hooks.

BACKGROUND OF THE INVENTION

Heretofore, it has been common practice for retail establishments that sell paint brushes and the like to display the brushes on wire hooks mounted to vertical panels of display islands or wall assemblies. The wire hooks include an attachment end configured for removable securement to the panel and a wire peg portion that extends outwardly from the panel for vertical hanging support of the paint brushes therefrom.

Paint brushes are usually shipped in bulk to the retailer who must then insert the brushes by hand onto the hooks. Care must be taken to group types and sizes of brushes onto the correct hooks to correspond with appropriate labeling. Additionally, if the display is to be altered to present different sized brushes, the hooks must be repositioned to accommodate the changed dimensions.

The brushes could of course be displayed without ever removing the brushes from the shipping boxes. However, such a display would not be compatible with existing hanging paint brush displays which are preferred because of their orderly appearance and easy customer access.

SUMMARY OF THE INVENTION

The present invention provides an improved merchandising system that permits paint brushes and the like to be displayed in a manner which is compatible with the hanging paint brush displays currently in use without having to remove the brushes from the shipping cartons therefor. Briefly, this is accomplished by providing the shipping cartons with a wire frame having upstanding rods or pegs for hanging support of a plurality of paint brushes, and brackets for removably supporting the cartons at a desired angle on a merchandiser panel or the like. As will be appreciated, such a system eliminates the substantial cost and time of having to remove the brushes from the shipping cartons and insert the brushes by hand onto the merchandising display hooks. Although the brushes remain in the shipping cartons, the merchandising system of the present invention provides for the orderly storage and display of the brushes substantially in the same manner as a hook merchandiser.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
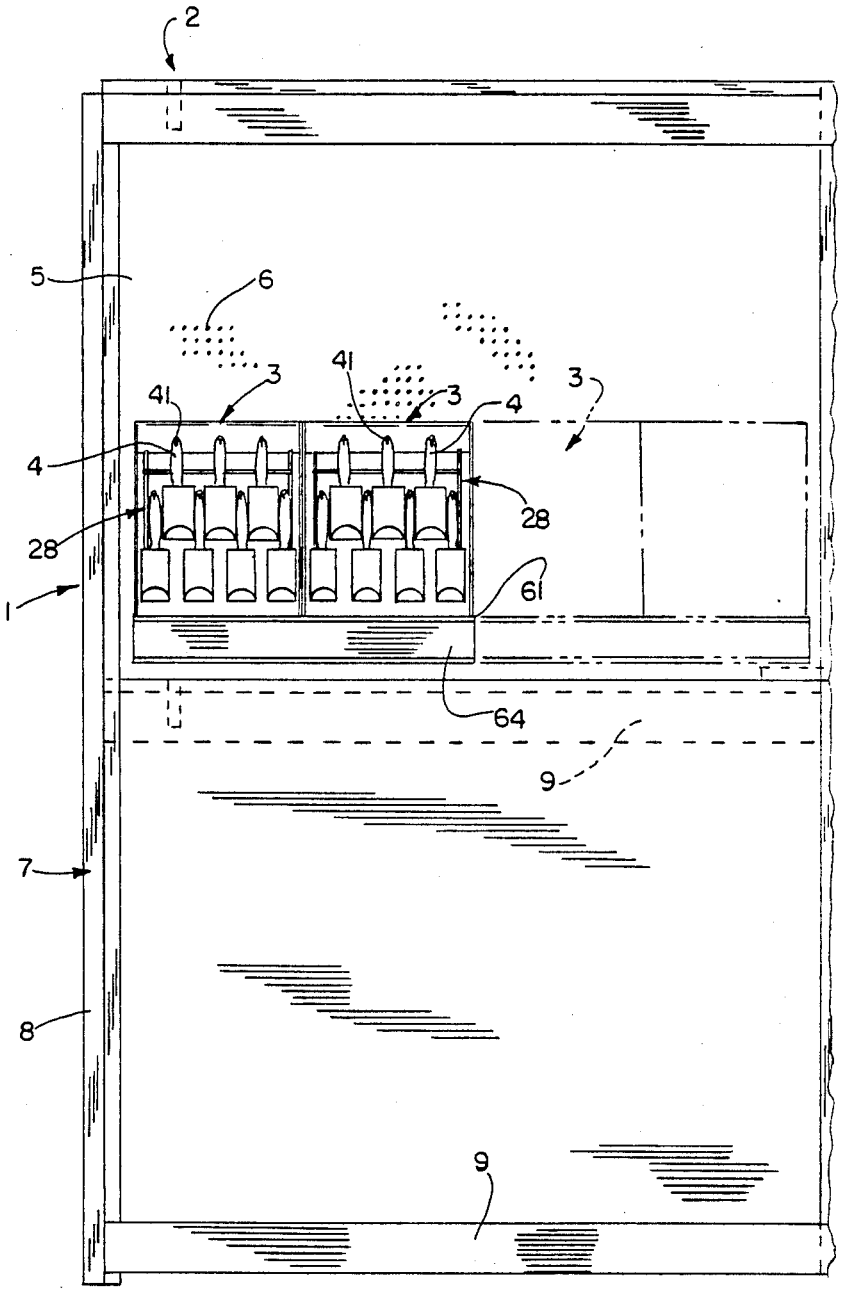
FIG. 1 is a fragmentary front elevation view of a preferred form of paint brush merchandising system in accordance with this invention.
Figure 2:
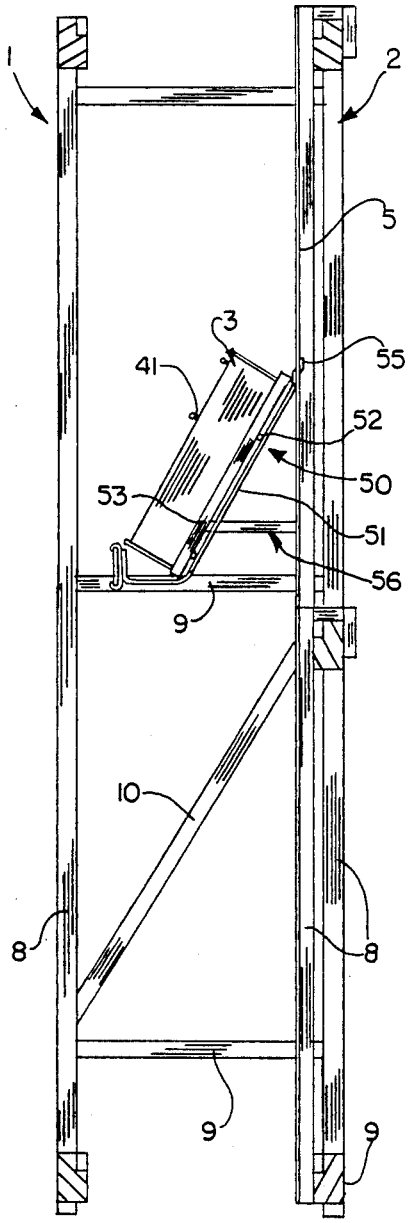
FIG. 2 is a side elevation view, partly in section, of the system of FIG. 1.

Referring now in detail to the drawings, and initially to FIGS. 1 and 2, a paint brush merchandising system according to the invention is indicated generally at 1 and includes a merchandiser 2 for receipt of a plurality of shipping cartons 3 each containing a plurality of paint brushes 4 or the like which may be of any desired size and shape. The merchandiser 2 includes an apertured panel 5 which may be of the pegboard type illustrated or some other suitable type as desired. Extending through the panel 5 are a plurality of apertures 6 which may be uniformly spaced apart. The panel is mounted on a structural frame 7 which may include the usual vertical, horizontal and angled beam supports 8–10.

Figure 5:
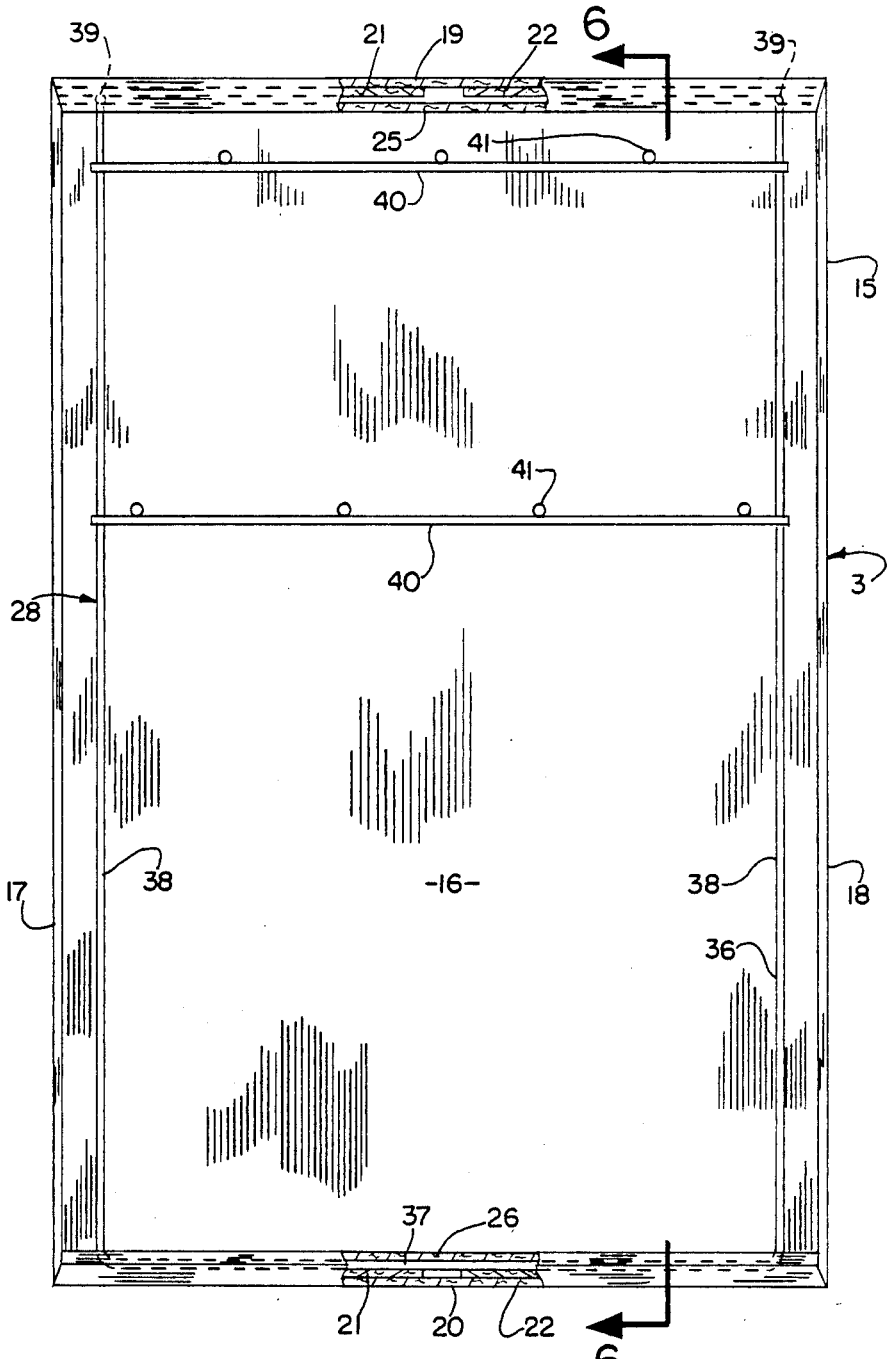
FIG. 5 is a further enlarged top plan view, partially broken away, of a shipping carton with wire frame retained therein.
Figure 6:
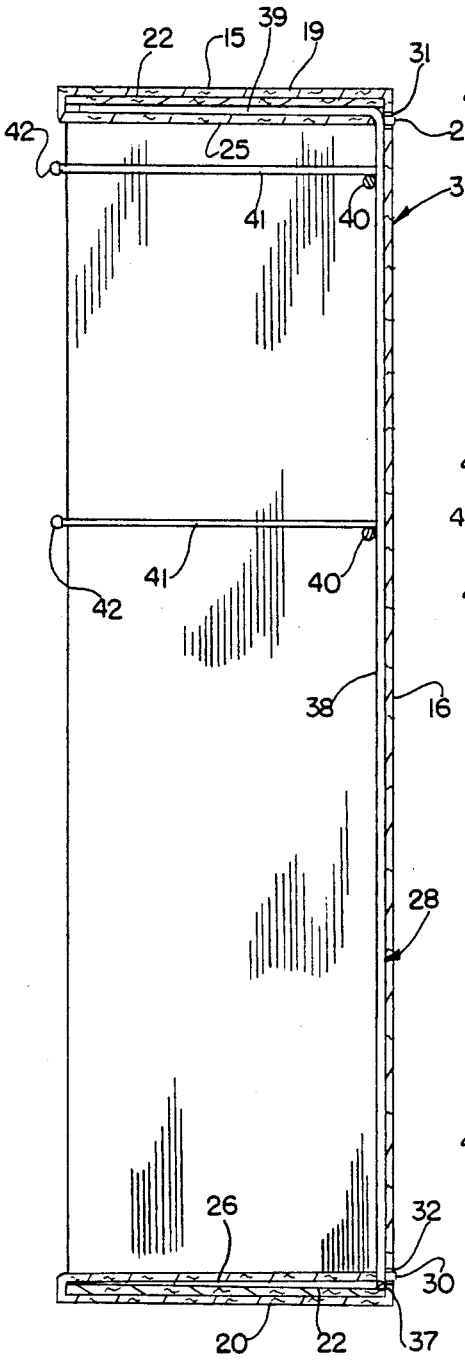
FIG. 6 is a sectional view through the carton and wire frame of FIG. 5 taken generally along the plane of the line 6—6 thereof.

As best seen in FIGS. 5 and 6, each shipping carton 3 comprises an open-top box 15 which may be die-cut out of cardboard, and includes a base or bottom wall 16, side walls 17, 18, and end walls 19, 20. While the side and end walls 17–20 may be of varying lengths, they are all of the same height. At opposite ends of the side walls 17, 18 are end flaps 21, 22 which extend generally at right angles from the side walls toward each other interiorly of the end walls 19, 20. At the upper ends of the end walls 19, 20 are additional flaps 25, 26 which when folded over the end flaps 21, 22 into the carton interior, hold the carton 3 together and retain a wire frame 28 within the carton as described hereafter. Along the bottom edges of the additional flaps 25, 26 are one or more tabs 29, 30 which are adapted to be received in corresponding slots 31, 32 in the bottom surface 16 of the carton 3 for retaining the additional flaps in place (see FIG. 6).

Figure 3:
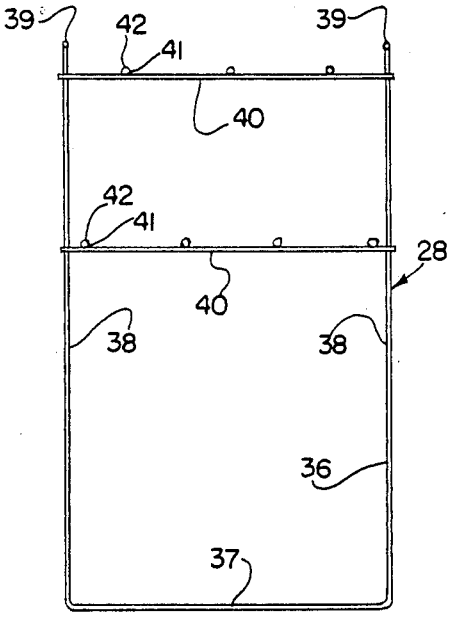
FIG. 3 is an enlarged top plan view of a fabricated wire frame for use in hanging the brushes within a shipping carton.
Figure 4:
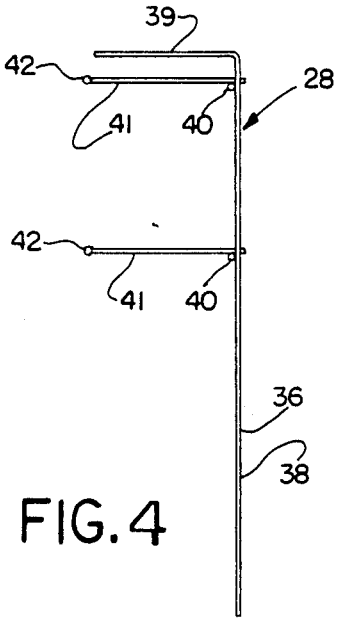
FIG. 4 is a side elevation view of the wire frame of FIG. 3.

One such wire frame 28 is illustrated in FIGS. 3 and 4 prior to insertion into the carton 3, and includes a generally U-shape planar wire base member 36 having a cross member 37 and two parallel side legs 38 extending generally at right angles from the ends of the cross member 37. The distal end of each side leg 38 is bent generally perpendicular to the plane of the base member 36 to form upstanding flanges 39 for use in retaining the wire frame 28 within a carton 3 as described hereafter. Extending between the two side legs 38 are two or more horizontal wire supports 40. The ends of the horizontal supports 40 are secured to the side legs 38 as by spot welding. Also, a plurality of spaced apart upstanding rods or pegs 41 are desirably spot welded to the horizontal supports 40 with the pegs 41 extending generally perpendicular from the supports in the same general direction as the flanges 39. As best seen in FIGS. 4 and 6, the pegs 41 desirably extend outwardly slightly beyond the flanges 39, for a purpose to be subsequently described. Also, the distal ends 42 of the pegs 41 are desirably upset or otherwise deformed to make them round so as to eliminate any sharp edges.

The wire frames 28 are intended to be used to support a plurality of rows of brushes 4 in spaced relation within the shipping cartons 3. The maximum permissible number of rows of brushes and number of brushes in each row will of course be determined by the size of the brushes in relation to the size of the shipping cartons therefor. In the exemplary embodiment shown in the drawings, each wire frame 28 is provided with two horizontal supports 40 for supporting two rows of two inch paint brushes, with four pegs 41 on the lowermost horizontal support of FIGS. 1 and 7 for supporting four stacks of brushes in the lowermost row and three pegs 41 on the uppermost horizontal support 40 for supporting three stacks of brushes in the uppermost row. Also, the number of brushes in each stack will vary depending on the thickness of the brushes in relation to the height of the cartons 3. In the exemplary embodiment shown herein, six two inch brushes are provided in each stack.

Of course, it will be appreciated that different size brushes having substantially the same overall length but different widths may be displayed in the same size carton simply by changing the number and spacing of the pegs 41 in each row. For example, two pegs 41 could be provided in the top row and three pegs in the bottom row for supporting two stacks of three inch brushes in the top row and three stacks of three inch brushes in the bottom row in the same size carton as for the two inch brushes previously described. Alternatively, one peg 41 could be provided in the top row and two pegs in the bottom row for supporting one stack of four inch brushes in the top row and two stacks of four inch brushes in the bottom row in the same size carton. For other size brushes, such as one inch brushes, it is preferable to use a different size carton in order to maximize the number of brushes that can be stored and displayed in each carton.

Figure 7:
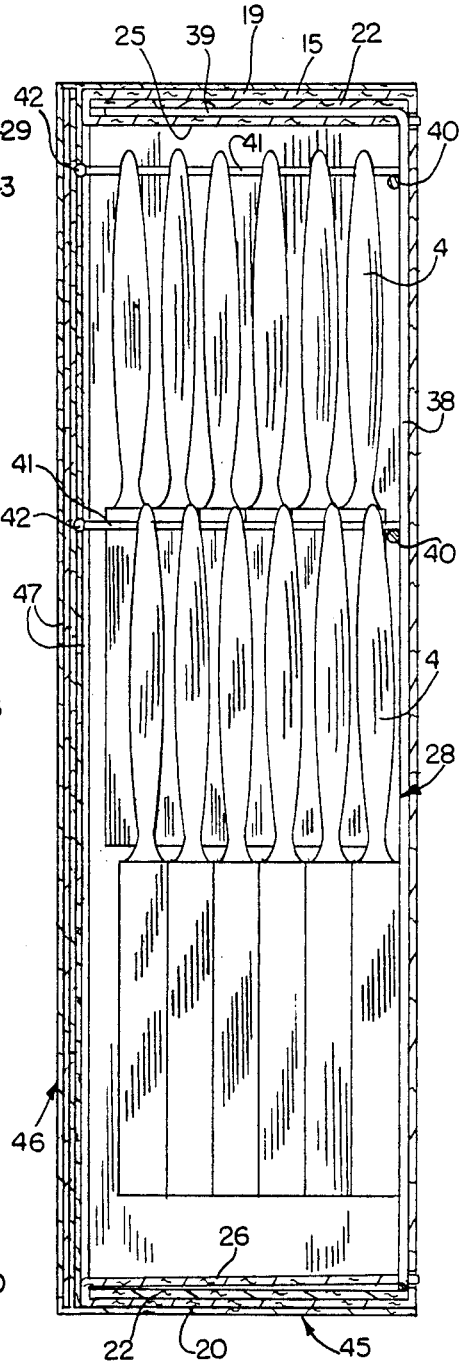
FIG. 7 is a sectional view through the shipping carton and wire frame similar to FIG. 6, but showing brushes hanging from the wire frame and a cover placed over the top of the carton.

FIGS. 5–7 illustrate how one such wire frame 28 is retained in a carton 3 with its base member 36 laying flat against the bottom wall 16 of the carton and the cross member 37 at one end of the base member trapped behind one of the downturned flaps 26 and the flanges 39 at the other end of the base member extending upwardly behind the other downturned flap 25. The flaps 25, 26 are retained in place by engagement of the tabs 29, 30 in the respective slots 31, 32 in the bottom wall 16 of the carton as previously described.

The length of the flanges 39 is slightly less than the height of the carton walls 17–20 to permit such a nested arrangement. However, the length of the pegs 41 is desirably somewhat greater than the height of the carton walls so that the outer ends 42 of the pegs 41 protrude slightly out of the box. Accordingly, when a cover 45 is placed over the top of the box after the box has been filled with the desired number of brushes 4, the outer ends 42 of the pegs 41 will partially penetrate the cover top wall 46 as schematically shown in FIG. 7. This gives added support to the pegs 41 so they do not bend under the weight of the brushes 4. Also, the brushes 4 cannot accidentally come off the pegs 41 during shipment and handling. Preferably, the cover top wall 46 is made of three to four cardboard layers 47 so that the pegs 41 can penetrate one or two of the layers 47 without penetrating all the way through the cover top wall.

The cover 45 may be secured to the carton 3 during shipment and handling as by taping the sides of the cover to the bottom of the carton. Also, if desired, pieces of cardboard or the like (not shown) may be inserted between various stacks of brushes to keep the brushes from swinging about their respective pegs 41 during shipment and handling.

The overall length of the wire base member 36 must of course substantially correspond to the length of the bottom wall 16 of the carton 3 in order for the cross member 37 and upstanding flange 39 to be properly trapped behind the respective downturned (inturned) flaps 25, 26. However, the width of the base member 36 may be somewhat less than the width of the bottom wall 16 to save on wire. As schematically shown in FIG. 5, the width of the base member 3 need only be slightly greater than the distance between the two pegs 41 closest to the respective carton side walls 17, 18. The minimum spacing between these pegs 41 and the adjacent side walls 17, 18 must be slightly greater than one-half of the width of the brushes supported thereby. If, for example, the brushes have a two inch width, the minimum spacing between the pegs 41 and adjacent side walls should be slightly greater than one inch.

Figure 8:
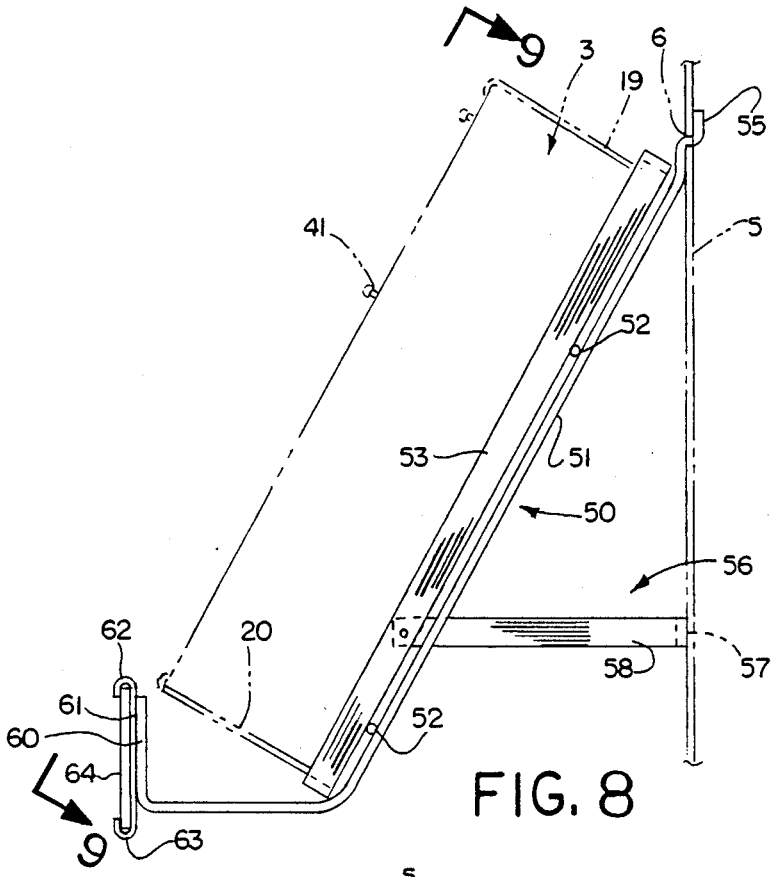
FIG. 8 is an enlarged side elevation view of a wire bracket used to support the cartons on the merchandiser.
Figure 9:
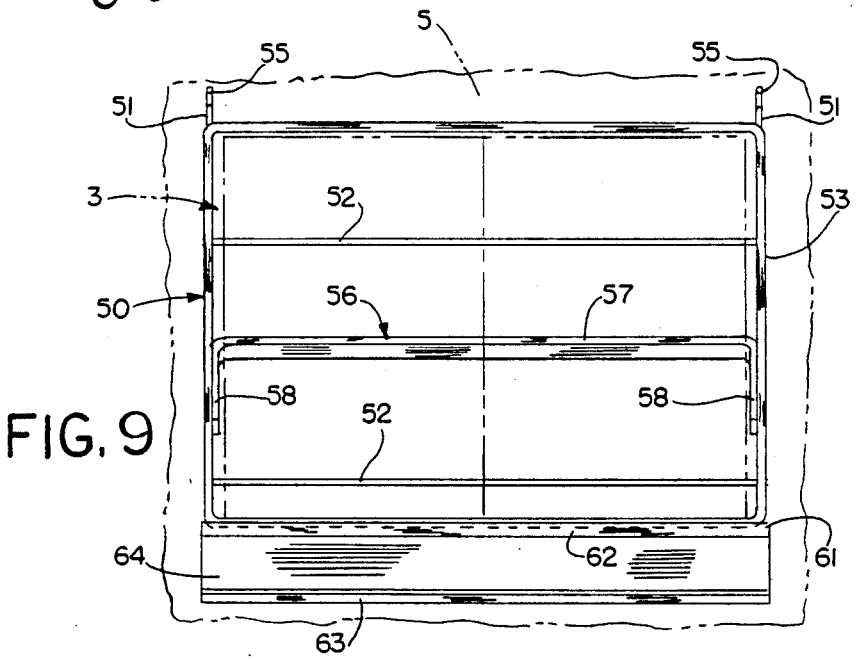
FIG. 9 is a reduced top plan view of the wire bracket of FIG. 8.

To display the brushes 4 while still in the cartons 3, all that is necessary is to remove the covers 45 from the cartons 3 and place the cartons 3 on a suitable merchandiser 2 (see FIGS. 1 and 2). For that purpose, special wire brackets 50 are provided for supporting the cartons 3 on the merchandiser 2 with the cartons extending downwardly at a desired angle (for example approximately 60° from the horizontal) for displaying the brushes hanging downwardly from the pegs 41. One such wire bracket 50 is shown in FIGS. 2, 8 and 9, and comprises two or more primary wire support members 51 joined together in spaced apart parallel relation by two or more wire cross members 52 which may be tack welded in place. Also tack welded to the cross members 52 is a rectangular frame 53 for receiving one or more cartons 3.

The rectangular frame 53 is preferably sized to receive two to four cartons 3 in side by side relation as schematically shown in FIG. 1. As an example, each frame 52 may be approximately one and one half feet wide and approximately two to four feet long for receiving two to four cartons 3 each having a length somewhat less than one and one half feet and a width somewhat less than one foot. If the rectangular frame 53 has a length of approximately two feet, only two primary wire support members 51 need be provided, whereas if the rectangular frame 53 has a length of approximately four feet, three primary wire support members 51 are desirably provided in equally spaced relation.

At the upper ends of the primary wire support members 51 are hooks 55 which are adapted to be received in apertures 6 in the panel member 5 for suspending the wire brackets 50 from the panel member. To take some of the load off of the hooks 55 and to maintain the wire brackets 50 at the desired angle, a support brace 56 extends rearwardly from the rectangular frame 53 in spaced relation from the hooks 55 for engagement with the front of the panel 5. Preferably, the support brace 56 is generally U-shape including a cross member 57 for engagement with the front of the panel 5 and a pair of support arms 58 which connect the cross member 57 to the rectangular frame 53.

The length of the support arms 58 is desirably such that when the cross member 57 engages the panel 5 with the support arms 58 generally horizontal as shown in FIGS. 2 and 8, the wire bracket 50 extends at an angle of approximately 60° with respect to the horizontal. However, it will be apparent that the angle or slope of the wire bracket 50 and thus the cartons 3 supported thereby may be varied simply by varying the length of the support arms 58 as desired. Moreover, the support arms 58 are desirably pivotally connected to opposite sides of the rectangular frame 53 to permit the support brace 56 to be pivoted up against the bottom of the wire bracket 50 when not in use to make the wire bracket 50 more compact for storage and shipment. If only two primary wire support members 51 are provided, the support brace 56 may be pivoted completely inside the rectangular frame 53, whereas if three or more primary wire support members 51 are provided, the support brace 56 can only be pivoted up against the underside of the primary wire support members.

Immediately adjacent the lower end of the rectangular frame 53, the primary wire support members 51 desirably extend generally horizontally beyond the end walls 20 of the cartons 3 supported thereby and then upwardly, terminating adjacent the upper edge of the carton end walls 20 when the wire bracket 50 is suspended from the panel member 5 as schematically shown in FIGS. 2 and 8. Attached to the vertical end portions 60 of the primary wire support members 51 as by spot welding is an advertising support panel 61 which may have inturned upper and lower edges 62, 63 to facilitate insertion and removal of cardboard inserts 64 having different advertising messages thereon. Preferably, the panel 61 extends substantially the entire length of the wire bracket 50 and substantially the slanted height of the carton end walls 20 when supported by the bracket so as to substantially conceal such carton end walls 20 from view.

To mount the wire brackets 50 at a desired position relative to the apertured panel 5, the brackets 50 are oriented approximately 90 to the panel to facilitate insertion of the hooks 55 into the appropriate apertures 6. Then the brackets 50 are swung downwardly until the support braces 56 abut against the apertured panel 5, thus prohibiting any further downward movement. At this point the brackets 50 are securely suspended from the panel 5 and will provide adequate support for two to four brush filled cartons 3 depending on the size of the rectangular frames 53.

The cartons 3 are of course already preassembled including the wire frames 28 with brushes 4 threaded at their handle holes onto the pegs 41 when they are shipped to the retailer. Accordingly, whenever the retailer wishes to display the brushes, all the retailer need do is remove the covers 45 from the cartons 3 and insert the cartons into the rectangular frames 53 on the wire brackets 50. When all of the brushes in a carton have been sold or otherwise disposed of, the retailer may simply replace the old carton with a new brush filled carton. Of course, if only a few brushes remain in a carton, the remaining brushes may be removed and inserted onto pegs of other cartons containing the same size and type of brushes and the empty carton replaced with a new carton as desired.

From the foregoing, it will now be apparent that the merchandising system of the present invention substantially reduces the time it takes for a retailer to display the brushes; i.e., to put the brushes on the shelf. The brush shipping cartons provide for the orderly storage and display of the brushes in a manner which is compatible with a hook merchandiser even though the brushes remain in the cartons.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A carton for use in shipping and displaying paint brushes and the like, said carton having a bottom wall and upstanding side and end walls and an open top, and a wire frame within said carton, said wire frame comprising a base member, means for retaining said base member against said bottom wall, and a plurality of pegs extending generally perpendicular from said base member in spaced apart relation for supporting a plurality of brushes from said pegs.

2. The carton of claim 1 wherein said base member includes generally parallel side members connected together by spaced apart support members extending between said side members, said pegs having one end attached to said support members in spaced apart relation along the length of said support members.

3. The carton of claim 1 wherein said means for retaining said wire frame against said bottom wall of said carton comprises downturned flaps on said end walls, and upstanding flanges at one end of said base member which are received between an adjacent end wall and one of said flaps.

4. The carton of claim 3 wherein said means for retaining said wire frame against said bottom wall further comprises a cross member at the other end of said base member which is received between the other end wall and the other flap.

5. The carton of claim 4 wherein said bottom wall has slots therein and said flaps have tabs which are received in said slots for holding said flaps in place.

6. The carton of claim 3 wherein said upstanding flanges have a height slightly less than the height of said side and end walls, and said pegs have a height slightly greater than the height of said side and end walls.

7. The carton of claim 6 further comprising a cover for said carton, said pegs partially penetrating said cover when said cover is forced down over the open top of said carton for providing added support for said pegs to keep said pegs from bending under the weight of the brushes during shipping and handling of said carton.

8. The carton of claim 7 wherein said cover includes a multilayered top wall which is partially penetrated by said pegs when said cover is forced down over the open top of said carton.

9. The carton of claim 8 wherein said pegs have rounded upper ends.

10. The carton of claim 1 wherein said base member has a length slightly less than the length of said bottom wall and a width slightly greater than the minimum spacing between said side walls and the pegs closest to the respective side walls.

11. The carton of claim 10 wherein the width of said base member is approximately one to four inches less than the width of said bottom wall.

12. A merchandising system for paint brushes and the like comprising an upstanding panel member, a plurality of cartons containing brushes, each said carton comprising a bottom wall and upstanding side and end walls and an open top, and a wire frame within said carton, said wire frame comprising a base member, means for retaining said base member against said bottom wall, and a plurality of pegs extending generally perpendicular from said base member in spaced apart relation for supporting a plurality of brushes from each of said pegs, said brushes having handles with holes therein which are threaded onto said pegs, and bracket means for supporting a plurality of said cartons at an angle relative to said panel member for displaying said brushes hanging downwardly at such angle from said pegs.

13. The merchandising system of claim 12 wherein said means for retaining said wire frame against said bottom wall of said carton comprises downturned flaps on said end walls, and upstanding flanges at one end of said base member which are received between an adjacent end wall and one of said flaps.

14. The merchandising system of claim 13 wherein said means for retaining said wire frame against said bottom wall further comprises a cross member at the other end of said base member which is received between the other end wall and the other flap.

15. The merchandising system of claim 14 wherein said bottom wall has slots therein and said flaps have tabs which are received in said slots for holding said flaps in place.

16. The merchandising system of claim 13 wherein said upstanding flanges have a height slightly less than the height of said side and end walls, and said pegs have a height slightly greater than the height of said side and end walls.

17. The merchandising system of claim 12 wherein said base member has a length slightly less than the length of said bottom wall, and a width slightly greater than the minimum spacing between said side walls and the pegs closest to the respective side walls.

18. The merchandising system of claim 12 wherein said bracket means comprises wire support means having hook means at one end for hooking engagement in apertures in said panel member, a back brace member extending rearwardly from a back side of said bracket means in spaced relation from said hook means for engaging said panel member to support said bracket means at such angle, and rectangular frame means attached to said wire support means for receipt of one or more of said cartons.

19. The merchandising system of claim 18 wherein said frame means is sized to receive at least two of said cartons in side by side relation.

20. The merchandising system of claim 18 wherein said frame means is sized to receive four of said cartons in side by side relation.

21. The merchandising system of claim 18 wherein said wire support means comprises at least two laterally spaced apart wire support members each having hook means at one end for hooking engagement in apertures in said panel member, and a plurality of wire cross members extending between said wire support members.

22. The merchandising system of claim 18 wherein said back brace member is pivotally connected to said rectangular frame means to permit said back brace member to be pivoted up against an underside of said bracket means for storage or shipment.

23. The merchandising system of claim 22 wherein said back brace member is generally U-shape including a cross member engageable with said panel member and a pair of support arms extending from opposite ends of said cross member, said support arms being pivotally connected to said rectangular frame means.

24. The merchandising system of claim 21 wherein each of said wire support members includes a generally forwardly extending portion adjacent a lower end portion of said rectangular frame member, said generally forwardly extending portions having generally upwardly extending portions terminating adjacent an upper edge of the lower end walls of said cartons, and panel means attached to said upwardly extending portions for substantially concealing said lower end walls of said cartons.

25. The merchandising system of claim 24 wherein said panel means has inturned upper and lower edges to facilitate insertion and removal of advertising inserts therein.

* * * * *